US005242168A

United States Patent [19]

Aizawa

[11] Patent Number: 5,242,168

[45] Date of Patent: Sep. 7, 1993

[54] GOLF CLUB HEAD

[75] Inventor: Yuichi Aizawa, Tokyo, Japan

[73] Assignee: Daiwa Golf Co., Ltd., Higashikurume, Japan

[21] Appl. No.: 905,387

[22] Filed: Jun. 29, 1992

[30] Foreign Application Priority Data

Jul. 9, 1991 [JP] Japan ..... 3-052883[U]

[51] Int. Cl.[5] ..... A63B 53/04

[52] U.S. Cl. ..... 273/167 H; 273/DIG. 7; 273/DIG.23; 273/DIG. 8

[58] Field of Search ..... 273/167-175, 273/77 R, 77 A, DIG. 7, DIG. 23, DIG. 8, 78

[56] References Cited

U.S. PATENT DOCUMENTS 4,076,254 2/1978 Nygren ..... 273/173
4,438,931 3/1984 Motomiya ..... 273/167 H
4,479,652 10/1984 Nagamoto ..... 273/172
4,624,460 11/1986 Murase et al. ..... 273/167 H
4,768,787 9/1988 Shira ..... 273/175
4,778,185 10/1988 Kurokawa ..... 273/167 H
4,928,972 5/1990 Nakanishi et al. ..... 273/167 H X

FOREIGN PATENT DOCUMENTS 59-14863 1/1984 Japan .

*Primary Examiner*—Vincent Millin
*Assistant Examiner*—Sebastiano Passaniti
*Attorney, Agent, or Firm*—Longacre & White

[57] ABSTRACT

A golf club head has a main body of head formed by coating the surface of a filling member made from foaming synthetic resin or the like with layers of fiber reinforced resin such as carbon reinforced resin, glass fiber reinforced resin. A metallic thin film layer is provided in the proximity of an outer surface of the main body of head.

15 Claims, 1 Drawing Sheet

GOLF CLUB HEAD

BACKGROUND OF THE INVENTION

The present invention relates to a golf club head improved in a hitting feeling and hitting tone for a planyer.

Recently, in place of a natural wood club whose head are made of natural wood such as a persimmon tree and a cherry tree, there has been developed a so-called "wood" club whose head main body is formed in such a manner that a layer of fiber reinforced resin such as carbon fiber reinforced resin and glass fiber reinforced resin is subjected to compression molding on the surface of a filling member (head core) composed of synthetic resin foam, from the viewpoint of stability in quality and facility in material supplying property. A sole plate formed of aluminum, brass or the like is fixed onto a sole part of the head main body of such "wood" club.

These fiber reinforced resins have high impact resilience, and therefore, are suitable for manufacturing a golf club head having a good ball flying performance.

However, when a player hits a golf ball, these fiber reinforced resins produce different feeling and hitting tone from those of a wooden golf club because of the difference in their characteristics or difference in the structure of the heads, so that a player used to employ a wooden golf club feels uncomfortable. Accordingly, it has been also suggested, as disclosed in Japanese Unexamined Patent Publication No. 59-14863, to provide a golf club head 9 shown in FIG. 3 adapted to obtain dry hitting tone at the time of hitting a ball by interposing a metallic thin film layer 5 in a boundary face between a fiber reinforced resin layer 1 and a filling member 3 so as to reflect the elastic wave of impact generated between a face surface on the fiber reinforced resin layer 1 and the ball upon the hit of the ball from the metallic thin film layer 5 without propagating it to the filling member 3. Further, the elastic wave of the impact is propagated to a shaft 7 side through the fiber reinforced resin layer 1 to easily get an actually hit feeling of the ball by the player.

According to the above-noted arrangement, it is a true that the foaming synthetic resin, the fiber reinforced resin and the metal are increased in the vibration transmission ability in this order, but the above described metallic thin film layer 5 is arranged in an inner part of the golf club head 9 with the fiber reinforced resin layer 1 provided on its peripheral part, and further the metallic thin film layer 5 is in contact with the filling member 3 composed of the foaming synthetic resin liable to damp the vibration.

Therefore, the elastic wave reaching the metallic thin film layer 5 which has the best transmissibility of vibration, is easily damped by the filling member 3 and the elastic wave is not completely transmitted to the shaft 7. Further, the vibration of the metallic thin film layer 5 is damped by the filling member 3, so that dry hitting tone peculiar to metal material can not be obtained upon the hitting of a ball.

SUMMARY OF THE INVENTION

The present invention was made in order to solve the problems mentioned above. Accordingly, an object of the present invention is to provide a golf club head formed of fiber reinforced resin by which a player can get a sense of the actually hitting of a ball and, at the same time, feel refreshed with an improved hitting tone when the ball is hit.

According to a main feature, a golf club head of the present invention having a main body of head comprises a filling member composed of foaming synthetic resin; and layers of fiber reinforced resin such as carbon fiber reinforced resin, glass fiber reinforced resin or the like coated on the surface of the filling member, a metallic thin film layer being provided in close proximity of an outer surface of the main body of head.

With this arrangement, when a ball is struck with a golf club equipped with a golf club head according to the present invention, the elastic wave of impact generated between the face of the golf club head and the ball at the time of hitting a ball is reflected on a metallic thin film layer. Since, according to the present invention, the metallic thin film layer is not in contact with a filling member liable to damp vibration and is provided in the proximity of an outer surface of the golf club head, the elastic wave reaching the metallic thin film layer with excellent transmissibility of vibration is not damped by the filling member and is transmitted to a shaft side. Hitting tone generated when the ball is hit is similar to that generated from a metallic head, because the vibration of the metallic thin film layer does not become weak.

BRIEF DESCRIPTION OF THE DRAWINGS

The present invention will become more apparent from the following description of the preferred embodiment, with reference to the accompanying drawings, in which.

DETAILED DESCRIPTION OF THE PREFERRED EMBODIMENT

Figure 1:
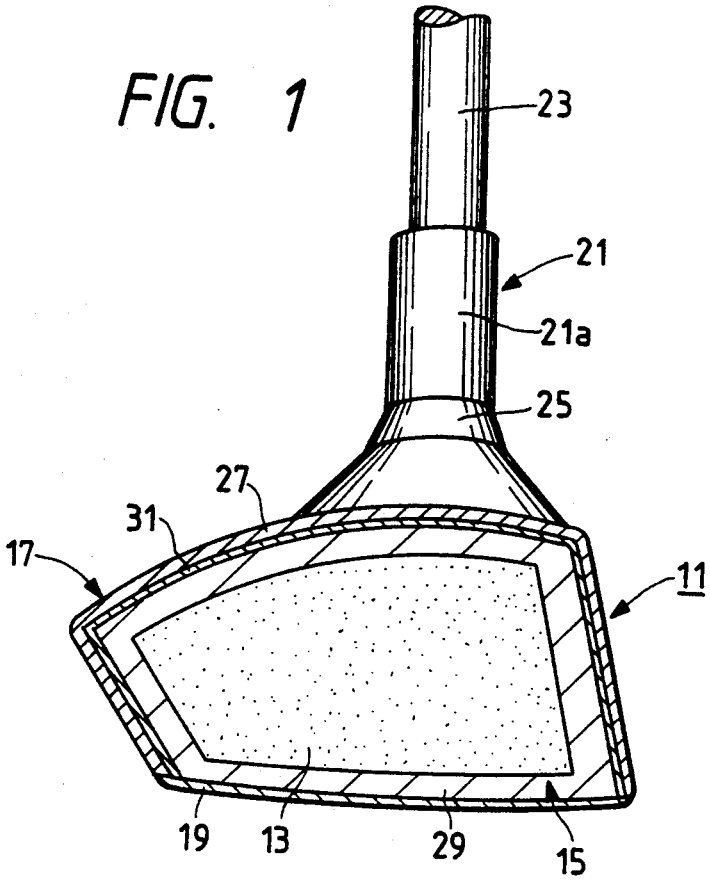
FIG. 1 is a sectional view of a golf club head according to an embodiment of the present invention.

Referring to the drawings, an embodiment of the present invention will be described in more detail.

In FIG. 1, a golf club head 11 of an embodiment according to the invention (called "head" hereinafter) comprises a head main body 17 including a filling member 13 coated with a fiber reinforced resin layer 15 and a metallic sole plate 19 fixed to a sole part of the head main body 17. The filling member 13 is made from a material with smaller specific gravity than that of the fiber reinforced resin layer 15. The filling member 13 is formed with, for example, a foaming synthetic resin having closed or independent cells, or a composite synthetic resin material having closed cells with specific gravity of 1 or smaller.

At the side of a heel of the head 11, a cylindrical metal tube member 21 is fixed. A nearly half part of the entire length of the metal tube member 21 protrudes upward from the head 11. This protruding part **21*a* is a hosel part on which a shaft 23 is connected. The metal tube member 21 is embedded along the direction of inserting the shaft 23 to the sole part of the head 11. In a boundary part between the metal tube member 21 and the fiber reinforced resin layer 15, there is formed an inclined part 25 with a diameter slightly larger than that of the metal tube member 21 along the contour of the head 11**.

Figure 2:
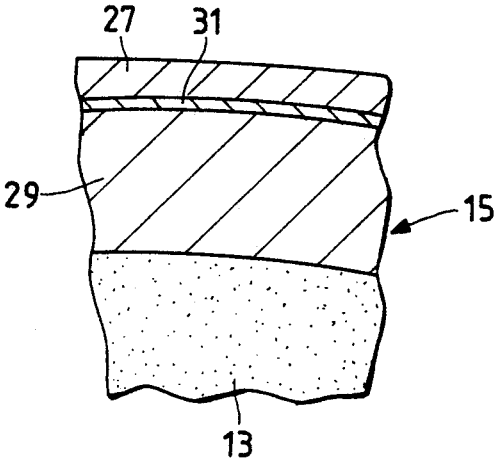
FIG. 2 is an enlarged sectional view of a main part of the head.

As shown in FIGS. 1 and 2, the above described fiber reinforced resin layer 15 of this embodiment comprises a glass fiber reinforced layer 27 covering an outer periphery of the main body 17 of head except the sole part to form an outermost layer of the main body 17 of head (except a coated face) and a carbon fiber reinforced resin layer 29 formed inside the glass fiber reinforced resin layer 27 and covering the filling member 13. Between the glass fiber reinforced resin layer 27 and the carbon fiber reinforced resin layer 29, there is provided a metallic thin film layer 31 at a position about 2 mm spaced apart from an outer surface of the main body 17 of head, along the outer periphery of the head main body 17 but the sole part.

The above mentioned glass fiber reinforced resin layer 27 is formed by coating the outer periphery of the main body 17 of head except the sole part with a woven fabric of glass fibers with thickness of approximately 0.2 mm. A metal such as amorphous titanium (generally, light metal) with thickness of 3 micron or so, is vapor deposited on the back face of the woven fabric so that this deposited metal enables the metallic thin film layer 31 to be formed inside the glass fiber reinforced resin layer 27.

The above described carbon fiber reinforced resin layer 29 is formed by suitably employing a woven fabric of carbon fiber reinforced resin or a fiber reinforced resin in which carbon fibers are arranged at random. As shown in FIG. 2, the carbon fiber reinforced resin layer 29 is formed thicker than the glass fiber reinforced resin layer 27. The metallic thin film layer 31 is located at the position in the proximity of the outer surface of the main body 17 of head about 2 mm spaced apart therefrom.

The main body 17 of head having the above mentioned structure is manufactured according to a method explained below.

The molding raw materials for the glass fiber reinforced resin layer 27 and the carbon fiber reinforced resin layer 29 are mounted on the sole plate 19 so as to surround the filling member 13. Then, they are disposed in a cavity of a metal mold for molding, and subjected to a thermo-compression in the mold to fabricate a one-piece structure. Sometimes, the surface of the resultant product may be subjected to polishing and further to painting.

Since the head 11 according to the present embodiment of the invention is assembled as mentioned before, when a ball is struck with a golf club equipped with the head 11, the elastic wave of impact generated between the face of the head 11 and the ball upon the striking of the ball reflects on the metallic thin film layer 31. In the head 11 according to the present embodiment, the metallic thin film layer 31 is not in contact with the filling member 13 liable to damp vibration, which is different from the head 9 shown in FIG. 3, and is disposed in the proximity of the outer surface of the head 11, so that the elastic wave reaching the metallic thin film layer 31 with good transmissibility of vibration is not damped by the filling member 13 but transmitted to the shaft 23 side. Hitting tone obtained when the ball is hit is similar to that generated from a metal head without damping the vibration of the metallic thin film layer 31 by the filling member 13.

Figure 3:
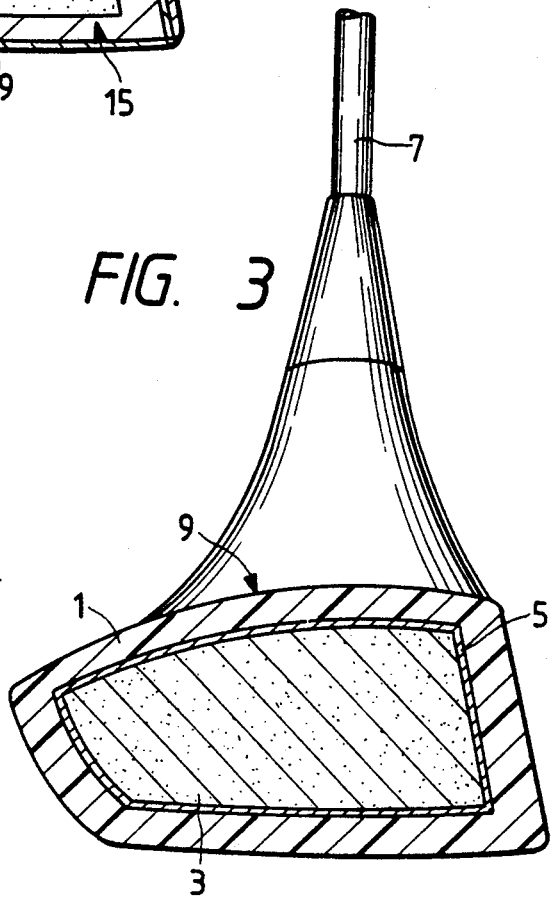
FIG. 3 is a sectional view of a conventional golf club head.

As mentioned above, since the metallic thin film layer 31 is not in contact with the filling member 13 and is provided close to the outer surface of the head 11, according to the embodiment of the present invention, dry hitting tone generated $ when the ball is hit is more similar to that obtained from the metal head than that obtained from the head 9 shown in FIG. 3. Further, since the elastic wave is not damped by the filling member 13 and is effectively transmitted to the shaft 23 side, in this embodiment, a player can have a ball hitting feeling more readily, compared with the conventional golf club head.

Moreover, since the carbon fiber reinforced resin layer 29 is provided inside the metallic thin film layer 31 and the metallic thin film layer 31 is provided in the proximity of the outer surface of the head 11; moment of inertia is increased and head speed is improved. As a result, the flying distance of the ball can be effectively extended, compared with that of the conventional head shown in FIG. 3.

According to the embodiment of the present invention, the corrosion of the metallic thin film layer 31 can be prevented by the glass fiber reinforced resin layer 27. If the glass fiber reinforced resin layer 27 is transparent or translucent, the metallic thin film layer 31 can be externally observed through the texture of the woven fabric of the glass fiber reinforced resin layer 27 so that the preferable appearance of the head is obtained.

In this embodiment, although the glass fiber reinforced layer 27 comprises a single layer, the invention is not to be restricted to such a construction. The construction may be modified such that the glass fiber reinforced layer comprise two or three layers laminated. It will be appreciated that the material of the fiber reinforced resin layer 15 is not restricted to glass fiber reinforced resin or carbon fiber reinforced resin.

As apparent from the above description, according to the present invention, hitting tone obtained at the time of hitting a ball is nearer to dry hitting tone obtained from a metal head, compared with a conventional head. Since the elastic wave generated in the golf club head of the invention is not damped by a filling member but effectively transmitted to a shaft side, a sense of actually hitting a ball with feeling of refreshment can be more readily obtained readily than by the conventional golf club head.

In addition, according to the present invention, a fiber reinforced resin layer is provided inside a metallic thin film layer and the metallic thin film layer is provided in the proximity of an outer surface of the head so that moment of inertia is increased and head speed is improved. Accordingly, compared with the conventional head, the flying distance of a ball can be desirably extended.

The present invention is not confined to the embodiment described above, but may be embodied or practiced in other various ways without departing the spirits or essential of the invention.

What is claimed is:

1. A golf club head comprising:

a main body including an outer surface:

a filling member;

a fiber reinforced resin layer formed on said filling member; and a metallic thin film layer formed in said fiber reinforced resin layer in a proximity of said outer surface of said main body, said metallic thin film layer separating said fiber reinforced resin layer into a first resin layer and a second resin layer, said first and second layers comprising different materials.

2. The golf club head according to claim 1, wherein said first resin layer includes a carbon fiber reinforced resin layer and said second resin layer includes a glass fiber reinforced resin layer.

3. The golf club head according to claim 2, wherein said metallic thin film layer is interposed between said carbon fiber reinforced resin layer and said glass fiber reinforced resin layer such that said carbon fiber reinforced resin layer is remote from said glass fiber reinforced resin layer.

4. The golf club head according to claim 1, wherein said metallic thin film layer is not in contact with said filling member.

5. The golf club head according to claim 1, wherein said metallic thin film layer is located at a position spaced apart from said outer surface of said main body about 2 mm.

6. The golf club head according to claim 2, wherein said carbon fiber reinforced resin layer is thicker than said glass fiber reinforced resin layer.

7. The golf club head according to claim 2, wherein said glass fiber reinforced layer is cup-shaped and defines a recess, said carbon fiber reinforced resin layer being provided inside the recess of the glass fiber reinforced resin layer.

8. The golf club head according to claim 2, wherein said metallic thin film layer is formed of a metal of amorphous titanium, said metal being vapor deposited onto a surface of a woven fabric formed into said glass fiber reinforced resin layer.

9. The golf club head according to claim 1, further comprising: a cylindrical metal tube member fixed to said main body to form a hosel part.

10. The golf club head according to claim 1, wherein said filling member is made from a foamed synthetic resin.

11. The golf club head according to claim 1, wherein said filling member is made of material smaller in specific gravity than that of said fiber reinforced resin layer.

12. The golf club head according to claim 1, wherein said filling member is made of material not larger than specific gravity of 1.00.

13. A golf club head comprising:

a main body including:

a filling member;

a material encapsulating said filling member and forming a bottom of said main body, said material having a vibration transmission characteristic higher than that of said filling member a sole plate attached to said material at said bottom of said main body; and a metallic thin film layer formed on said material such that said material is substantially interposed between said metallic thin film layer and said filling member, wherein said metallic thin film layer and said sole plate together encapsulate said material and said filling member.

14. The golf club head according to claim 13, wherein said main body further includes: at least one glass fiber reinforced resin layer provided on said metallic thin film layer said.

15. The golf head according to claim 13, wherein said material is at least one carbon fiber reinforced resin layer.

* * * * *